US012595985B2

(12) United States Patent
Wilson et al.

(10) Patent No.: US 12,595,985 B2
(45) Date of Patent: Apr. 7, 2026

(54) CUSTOMER-SERVICEABLE FOREARM ASSEMBLY

(71) Applicant: O.F. MOSSBERG & SONS, INC., North Haven, CT (US)

(72) Inventors: John Wilson, East Waterboro, ME (US); Peter Duperry, North Haven, CT (US)

(73) Assignee: O.F. MOSSBERG & SONS, INC., North Haven, CT (US)

( * ) Notice: Subject to any disclaimer, the term of this patent is extended or adjusted under 35 U.S.C. 154(b) by 0 days.

(21) Appl. No.: 19/033,843

(22) Filed: Jan. 22, 2025

(65) Prior Publication Data

US 2025/0237471 A1 Jul. 24, 2025

Related U.S. Application Data

(63) Continuation-in-part of application No. 29/986,367, filed on Jan. 17, 2025.

(60) Provisional application No. 63/623,576, filed on Jan. 22, 2024.

(51) Int. Cl.
*F41C 7/02* (2006.01)
*F41C 23/16* (2006.01)

(52) U.S. Cl.
CPC ..... *F41C 23/16* (2013.01); *F41C 7/02* (2013.01)

(58) Field of Classification Search
CPC .... F41C 7/205; F41C 7/02; F41C 7/04; F41C 7/00; F41A 19/41
USPC ..... 42/75.03
See application file for complete search history.

(56) References Cited

U.S. PATENT DOCUMENTS

| | | | | |
|---|---|---|---|---|
| 3,075,313 A | | 1/1963 | Allyn | |
| 3,961,436 A | * | 6/1976 | Hagen | F41A 21/48 42/75.02 |
| 4,505,183 A | * | 3/1985 | Grehl | F41A 5/18 89/191.02 |
| 5,068,992 A | * | 12/1991 | Velezis | F41A 35/06 42/72 |
| 5,417,002 A | | 5/1995 | Guerra | |
| 8,844,425 B2 | * | 9/2014 | Mueller | F41A 3/84 42/1.06 |

(Continued)

FOREIGN PATENT DOCUMENTS

WO 2025160168 A2 7/2025

OTHER PUBLICATIONS

Hatsan Escort Action Bar Bushing Retainer C Clip—Old Style—12ga Legacy Sports (Year: N/A) (https://www.ebay.com/itm/164668116730) (Year: NA) (Year: NA).*

(Continued)

*Primary Examiner* — Reginald S Tillman, Jr.
(74) *Attorney, Agent, or Firm* — Kutak Rock LLP

(57) ABSTRACT

A firearm forearm assembly is provided. Generally included is a forearm retainer that is a flexible component installed in the forearm, which is then momentarily deflected to admit each action bar. Once the forearm assembly is installed in the firearm, the firearm's magazine tube is introduced and prevents further deflection of the retainer, thus locking the forearm assembly together during use. As a result, the forearm assembly is easily disassembled by the user without the use of tools by deflection of the retainer and removal of the action bars. But at the same time, the integrity of the firearm is preserved during operation.

20 Claims, 10 Drawing Sheets

(56) References Cited

U.S. PATENT DOCUMENTS

| | | | |
|---|---|---|---|
| 2004/0045207 | A1 | 3/2004 | Mcnulty, Jr. |
| 2011/0119982 | A1 | 5/2011 | Webber et al. |
| 2015/0128467 | A1 | 5/2015 | Fitzpatrick et al. |

OTHER PUBLICATIONS

"International Search Report and Written Opinion Received for International Application No. PCT/US2025/012589, Search completed on Jul. 21, 2025, Mailed on Jul. 22, 2025".

* cited by examiner

CUSTOMER-SERVICEABLE FOREARM ASSEMBLY

CROSS-REFERENCE TO RELATED APPLICATIONS

This application claims priority to U.S. Provisional Patent Application Ser. No. 63/623,576, filed Jan. 22, 2024, and to U.S. Design patent application Ser. No. 29/986,367, filed Jan. 17, 2025, the entire disclosures of which are incorporated herein by reference.

FIELD OF INVENTION

The present invention relates generally to firearms. More specifically, the present invention is concerned with a customer-serviceable forearm assembly for use with pump shotguns and other firearms.

BACKGROUND

In some firearms, and in pump shotguns specifically, the forearm (also known as the fore-end/forend, handguard or forestock) is a section of gunstock between the receiver and the muzzle. It is used as a gripping surface to hold the gun steady, and as an operating handle for the firearm's ammunition feeding mechanism and is usually made out of wood or reinforced plastics. Beneath the barrel of a pump shotgun there is often a magazine tube in which is stored cartridges, and on which the forearm is mounted.

Typical pump shotgun forearm assemblies consist of the forearm and one or more action bars. The conventional forearm assembly requires tools—often purpose-built—for assembly and disassembly. In some instances, forearm assemblies are not intended to be disassembled, and therefore cannot be disassembled without damage.

More specifically, in conventional forearm assemblies, action bars are linked to the forearms via a metal sleeve or armature assembly, or action bars are more directly attached to the forearms with either pins or screws. In the former example, special tools are required for installing or removing the forearm from the armature. In the later example, the assembly is most often considered non-disassemble-able because disassembly causes wear or damage.

The need for special tools to install, assemble, disassemble or repair forearm assemblies—or the inability to do any of the foregoing at all—present an obvious disadvantage of existing forearm assemblies. These existing drawbacks create an increased cost of repair or replacement, if such is even possible. And firearm owners are unable to service their own firearms due to lacking the specially dedicated tools, if repair is required in the field, or if replacement with a special purpose forearm is needed.

Accordingly, there is a need for forearm assembly that can be readily and repeatedly assembled and disassembled without tools and without damaging the firearm or the components thereof.

A conventional forearm is provided with a longitudinal hole through which the magazine tube is passed, and which then serves as the bearing surface upon the magazine tube. A drawback of molded polymer forearms is the need for this hole to be tapered to accommodate the molding process, resulting in unwanted clearance and undesired motion between the magazine tube and one end of the forearm. This deficiency is present in some firearms, while in other firearms it is remedied by the use of an additional component such as a sleeve or armature.

SUMMARY

The present invention comprises a customer-serviceable forearm assembly that provides for easy means to install and replace forearm components. The present invention also provides a molded polymer forearm assembly capable of fitting a firearm and functioning without undesired free motion. The present invention generally comprises a forearm assembly for use with shotguns and other firearms, the forearm assembly including a forearm, a forearm retainer, and one or more action bars.

In an exemplary embodiment, the forearm retainer is a flexible component installed in the forearm, which is momentarily deflected to admit each action bar. Once the forearm assembly is installed in the firearm, the firearm's magazine tube is introduced and prevents further deflection of the retainer, thus locking the forearm assembly together during use. As a result, the forearm assembly is easily disassembled by the user without the use of tools by deflection of the retainer and removal of the action bars. But at the same time, the integrity of the firearm is preserved during operation.

Further in an exemplary embodiment, the forearm retainer is located at the end of the molded polymer forearm in which the tapered hole for the magazine tube is largest. As the retainer necessarily bears against both the forearm and the magazine tube, undesired motion between the two is diminished without the use of an additional sleeve or armature.

The foregoing and other objects are intended to be illustrative of the invention and are not meant in a limiting sense. Many possible embodiments of the invention may be made and will be readily evident upon a study of the following specification and accompanying drawings comprising a part thereof. Various features and subcombinations of invention may be employed without reference to other features and subcombinations. Other objects and advantages of this invention will become apparent from the following description taken in connection with the accompanying drawings, wherein is set forth by way of illustration and example, an embodiment of this invention and various features thereof.

BRIEF DESCRIPTION

A preferred embodiment of the invention, illustrative of the best mode in which the applicant has contemplated applying the principles, is set forth in the following description and is shown in the drawings and is particularly and distinctly pointed out and set forth in the appended claims.

DETAILED DESCRIPTION

As required, a detailed embodiment of the present invention is disclosed herein; however, it is to be understood that the disclosed embodiment is merely exemplary of the principles of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Specifically, although the embodiments shown and described herein are those of pump shotguns or other similar firearms, it will be appreciated that other embodiments are adaptable to other types of firearms, now known or hereafter developed. Furthermore, it will be appreciated that other embodiments will utilize other types of structures for typical firearm components in addition to those described herein (e.g. receiver, bolt, barrel, trigger assembly, etc.).

As seen in FIGS. 1-4, an exemplary embodiment of the forearm assembly of the present invention generally includes a forearm 100, a forearm retainer 200, and one or more action bars 300.

Figure 1:
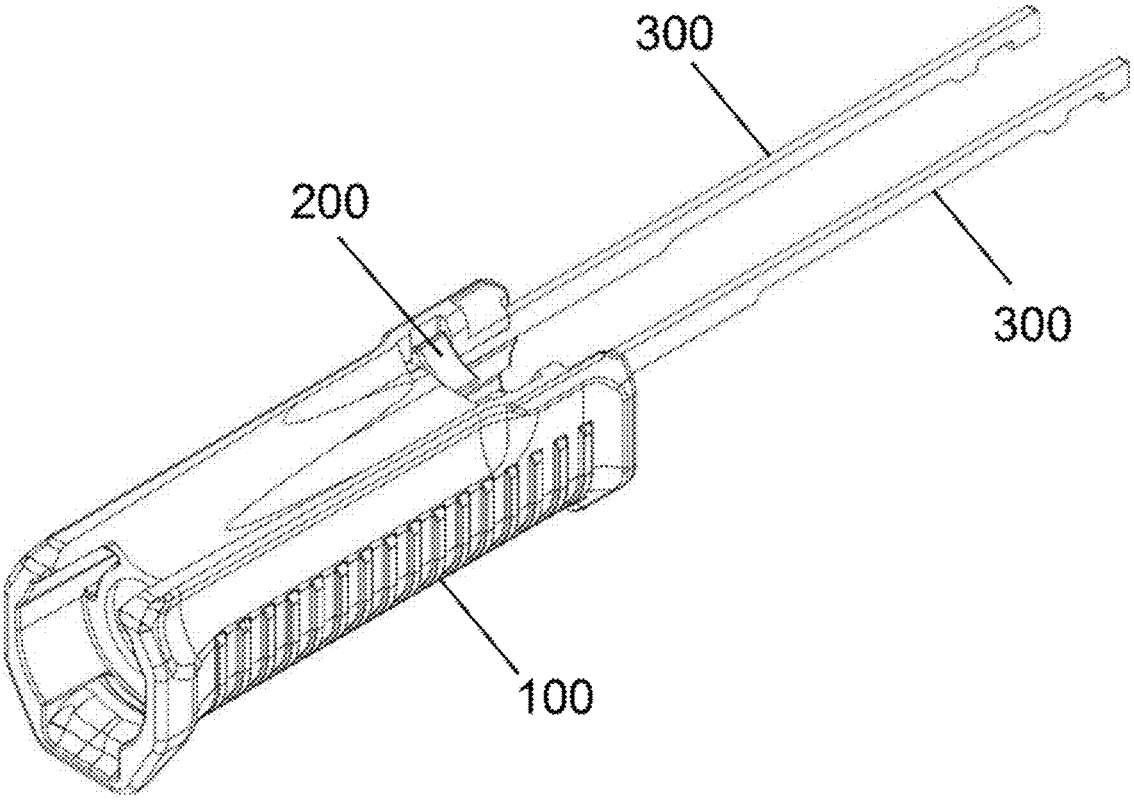
FIG. 1 shows a forearm assembly according to some embodiments of the present invention.
Figure 2:
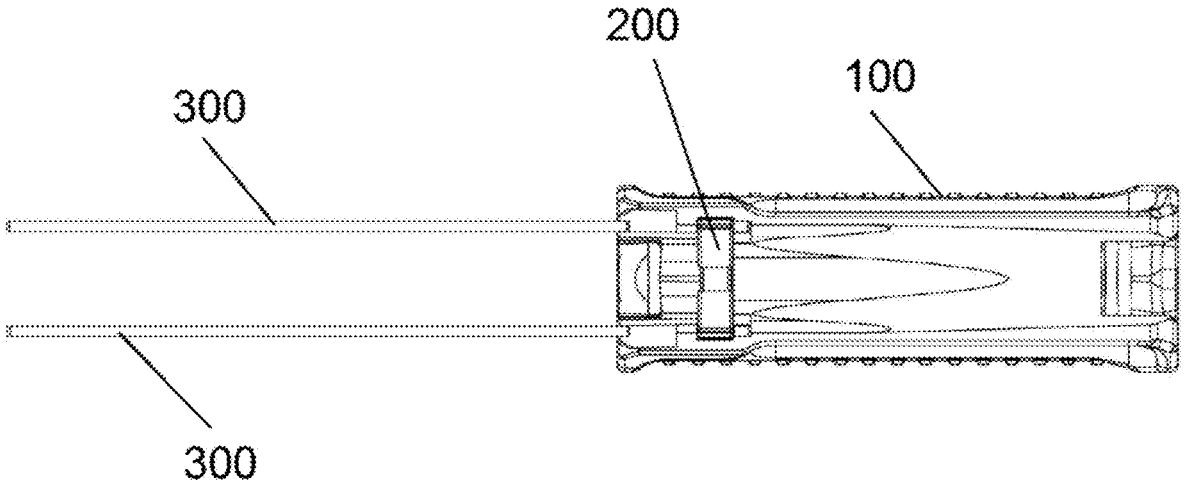
FIG. 2 is a top plan view of the forearm assembly according to FIG. 1.
Figure 3:
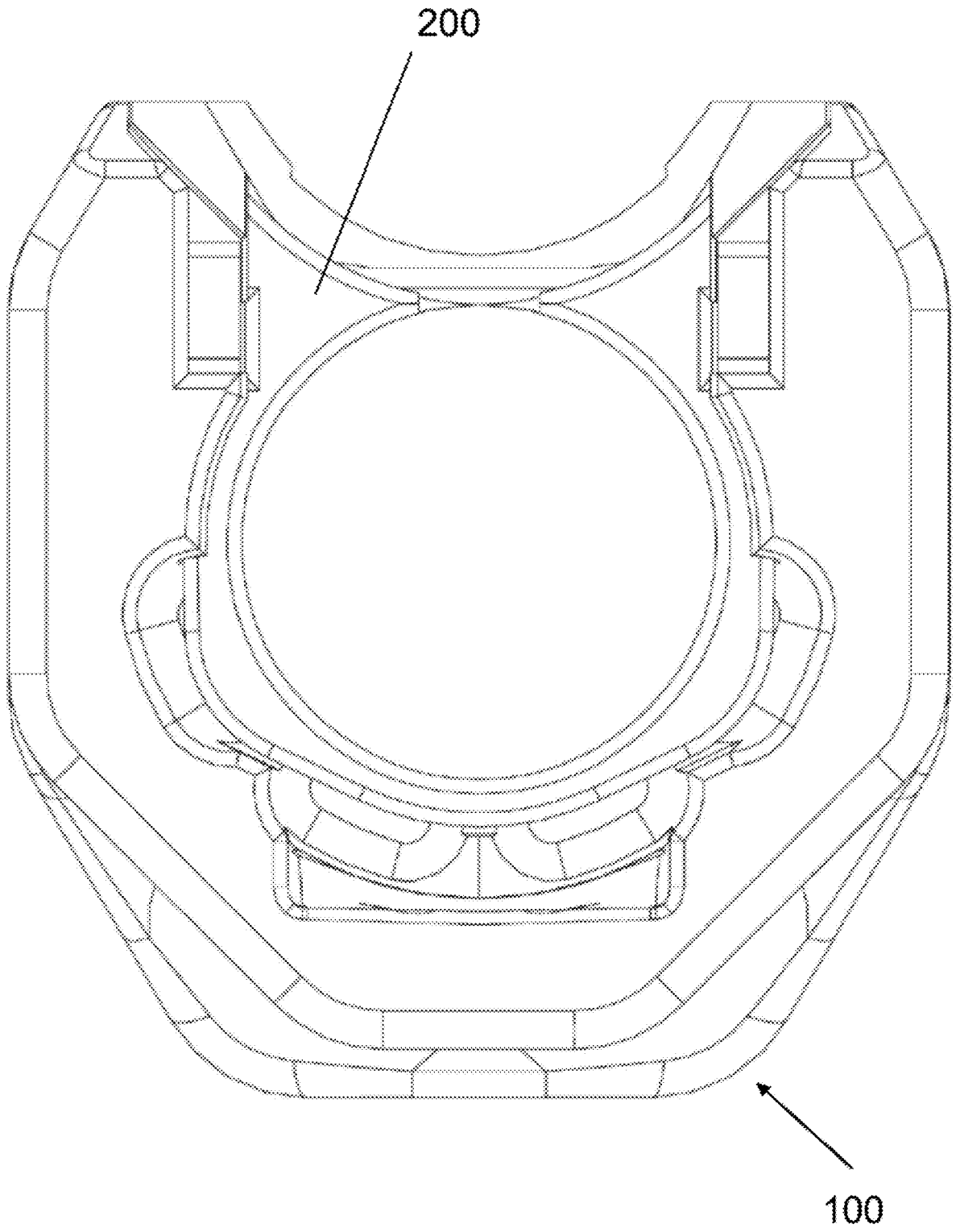
FIG. 3 is a rear elevation view of the forearm assembly according to FIG. 1.
Figure 4:
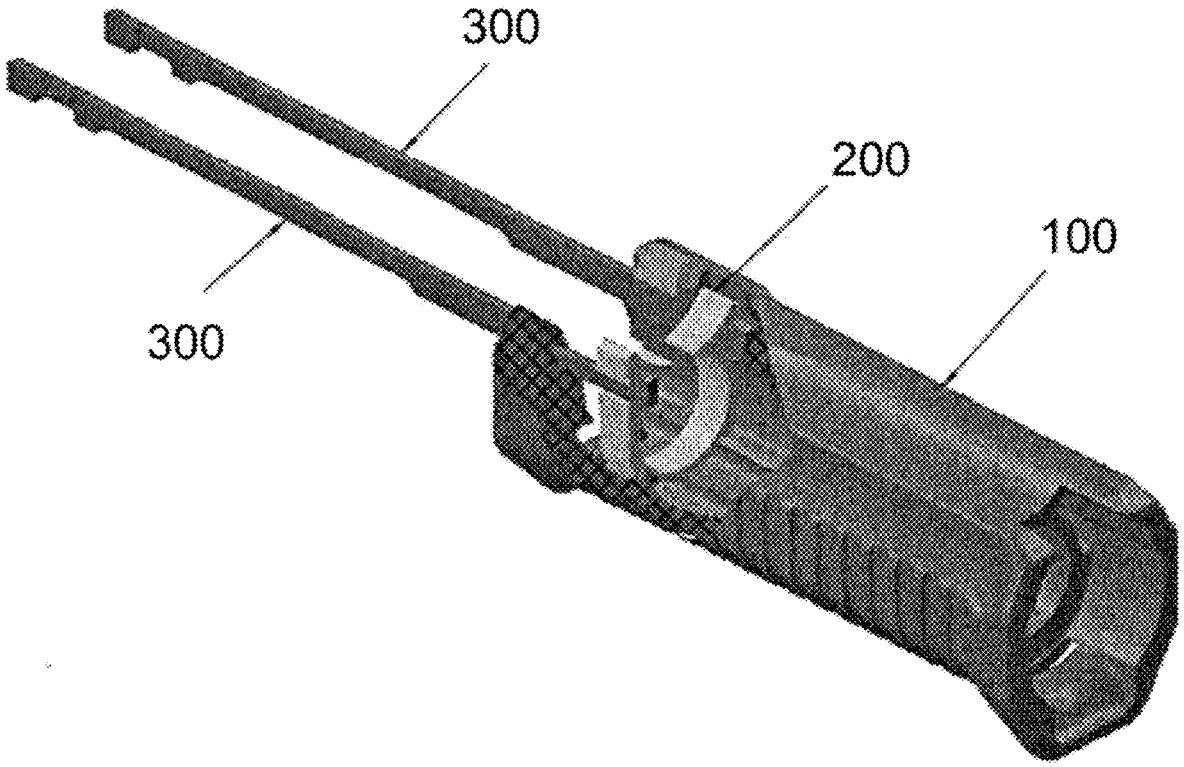
FIG. 4 is perspective view of a forearm assembly according to FIG. 1, with the forearm partially cut away for viewing of the internal components.
Figure 5:
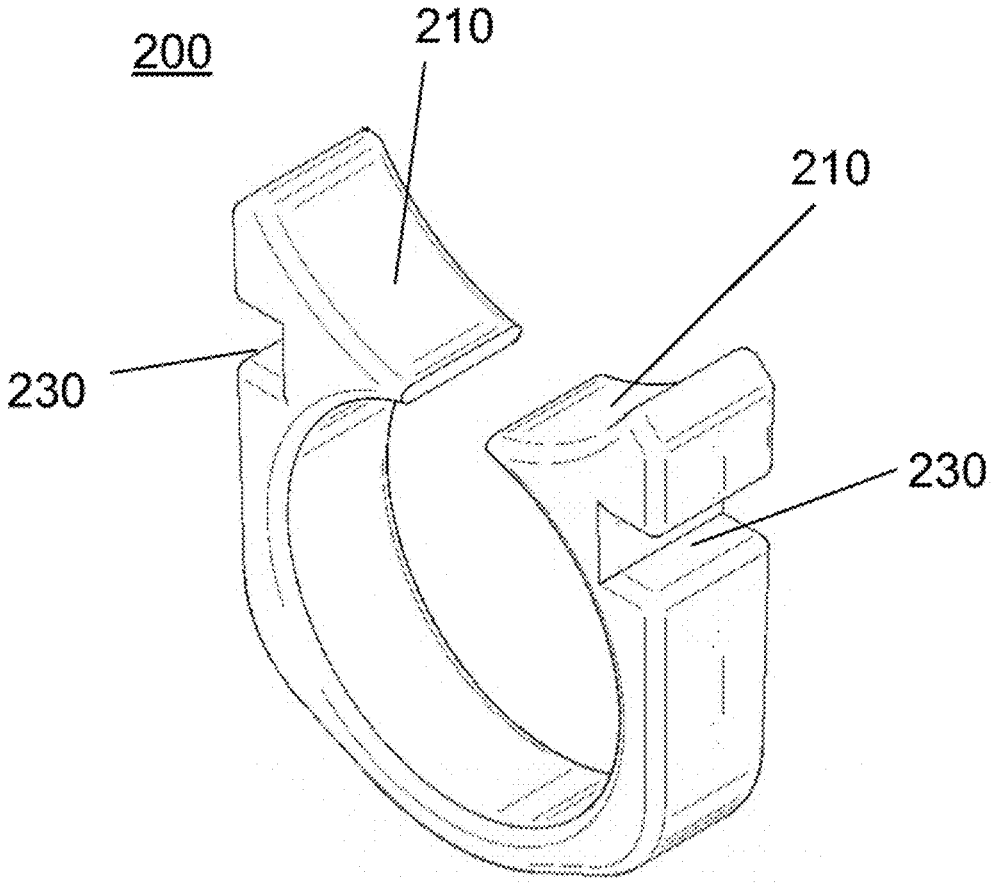
FIG. 5 show a retainer according to some embodiments of the present invention.

As seen in FIG. 5, in some embodiments, the forearm retainer 200 is roughly a "U" shaped with tabs 210 at either end, facing inward toward one another. Opposite each tab, near each end, on the outer perimeter of the retainer, are retainer bar slots 230. The retainer bar slots 230 are configured for receiving an action bar 300. In some embodiments, the forearm retainer 200 is a flexible component wherein either end is capable of being deflected, inter alia, by pulling on the tab.

Figure 6:
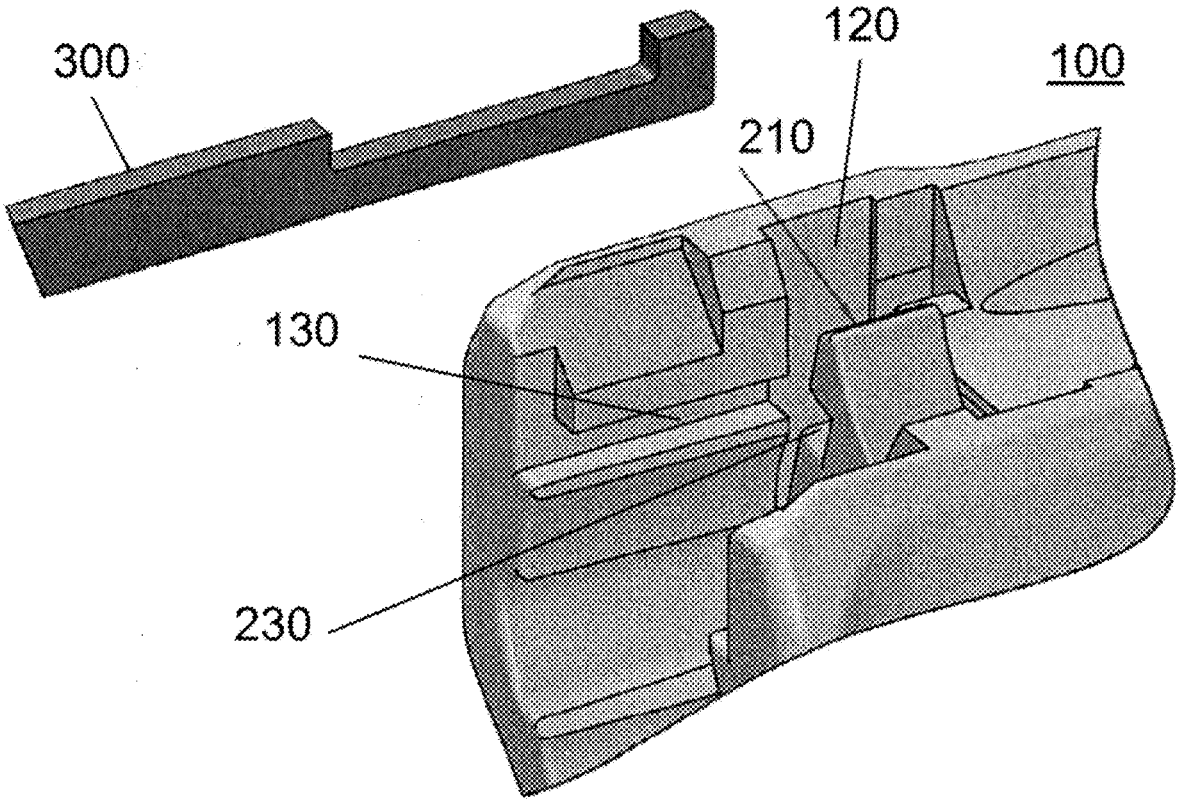
FIG. 6 shows a partial view of a forearm with a retainer installed, wherein the retainer tab has been pushed away from the retainer slot to allow for receipt of the shown action bar.
Figure 7:
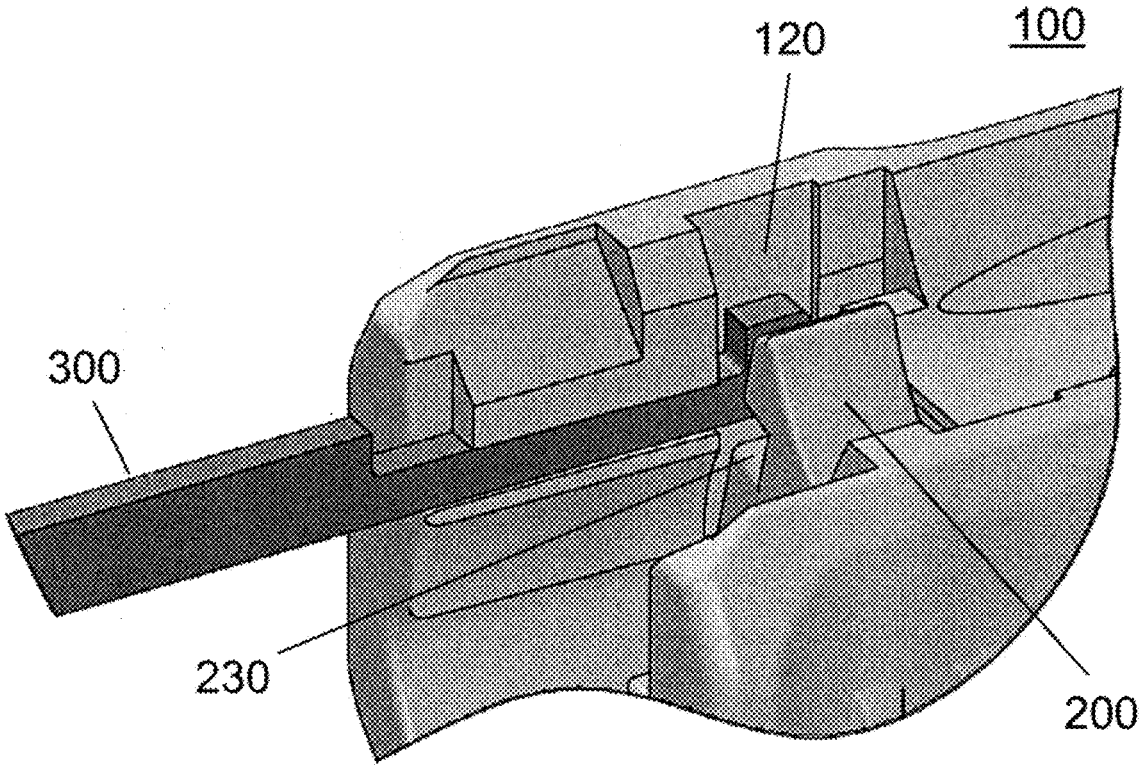
FIG. 7 shows the forearm of FIG. 6, with the action bar inserted, wherein the retainer tab is still being pushed way.
Figure 8:
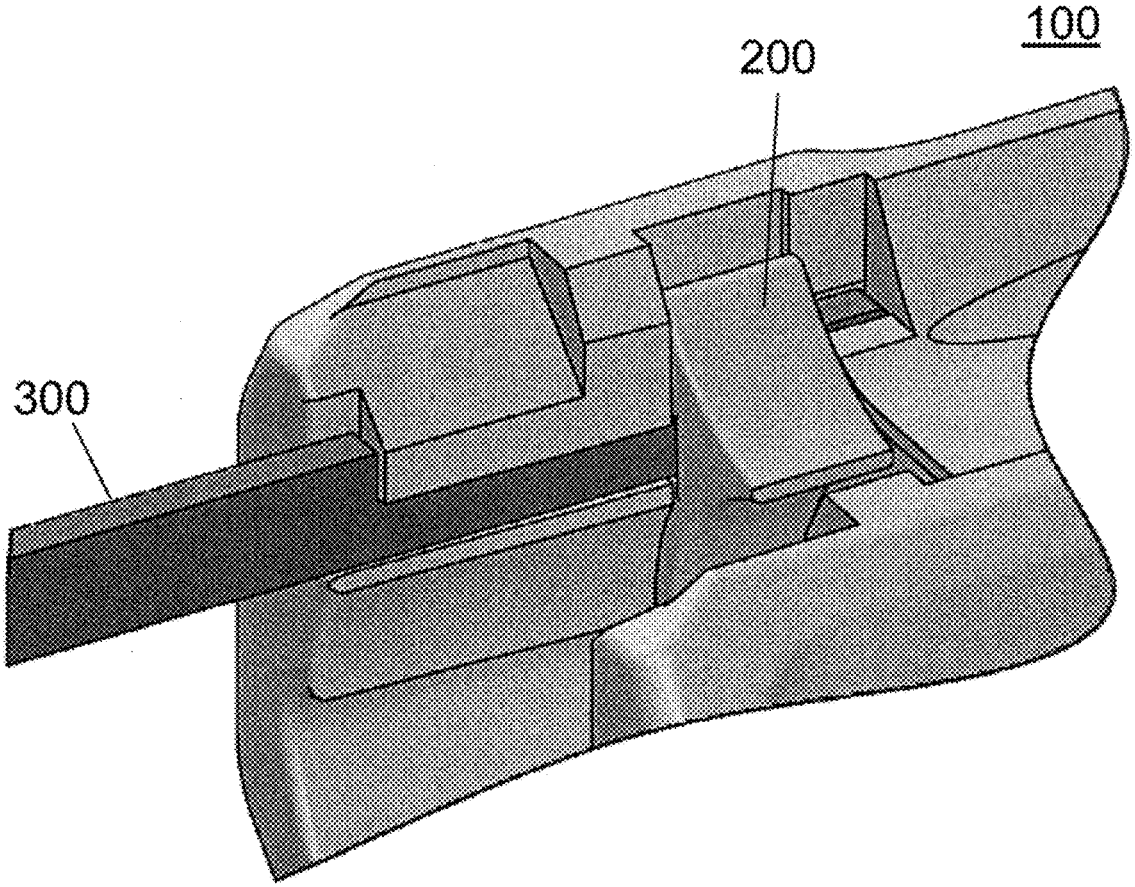
FIG. 8 shows the forearm of FIGS. 6 and 7, wherein the retainer tab has been released, and the retainer has returned to its position thereby holding the action bar in place.

As shown in FIG. 6-8, in some embodiments, a flexible forearm retainer 200 is installed in the forearm 100, and then is momentarily deflected on either end to admit each action bar 300. The forearm 100 includes a retainer slot 120 around its internal perimeter in which the retainer 200 is inserted into to be installed internally. The forearm 100 also includes one or more forearm bar slots 130 for receipt of the action bars 300. Each action bar 300 includes a rearward-facing surface for bearing against the retainer. The retainer 200 is installed in the forearm 100, then an operator is able to pull on a tab 210 on either side of the retainer 200 to flex that end slightly inward away from forearm, as seen in FIG. 6. This permits the action bar to be slid into place into the forearm bar slot 130, as seen in FIG. 7. Then the operator unflexes the tab 210 to allow the retainer 200 to move back into place in the retainer slot 120 in such a way that the action bar 300 enters the retainer bar slot 230. Then, as seen in FIG. 8, the action bar 300 is locked in place by the forearm bar slot 130 and retainer bar slot 230 and thereby held in place between the retainer 200 and internal wall of the forearm 100.

Conversely, the operator is able to again pull on either tab 210 to easily remove the respective action bar 300. Then said retainer 200 is removed from the retainer slot 120 of the forearm 100 for easy disassembly without the need for a specialized tool.

Figure 9:
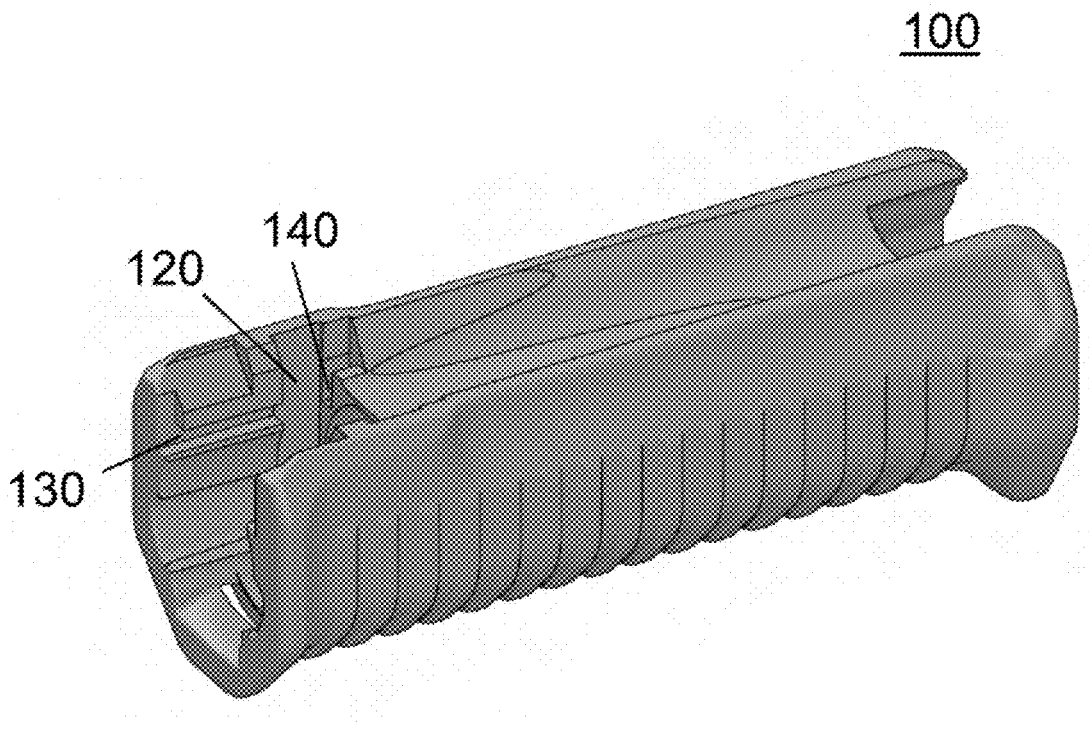
FIG. 9 shows a forearm according to some embodiments of the present invention.

Further, as seen in FIG. 9, in some embodiments the forearm bar slots 130 in the forearm 100 end in a pocket 140 in which the action bar 300 must be slid forward to bring its rearward facing surface forward of the retainer, thereby securing the action bar against all motion. The rear of the action bar is secure against the pocket and the sides are secure between the slots in the retainer and forearm.

Figure 10:
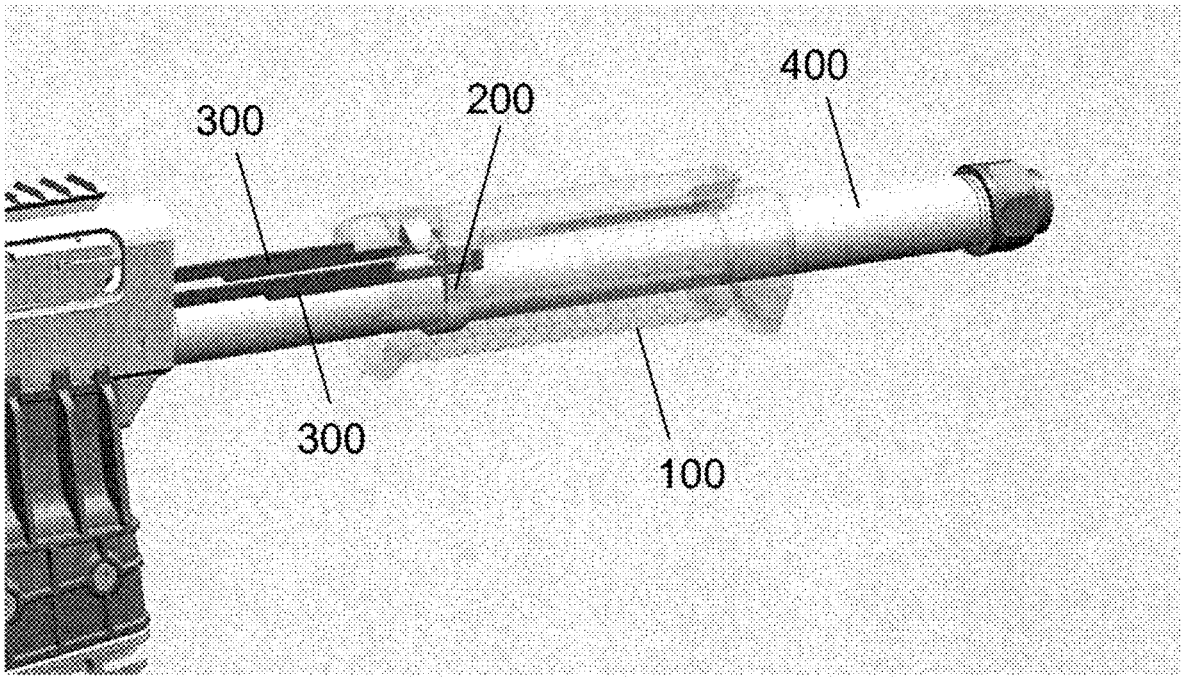
FIG. 10 shows a forearm assembly according to some embodiments of the present invention installed on a firearm.

As seen in FIG. 10, in some embodiments, once the forearm assembly is installed in the firearm, a magazine tube 400 is introduced through the center of the retainer 200. The magazine tube 400 prevents the ends of the retainer 200 from deflecting inward, thus locking the forearm assembly together during use. More specifically, the magazine tube 400 of the firearm is guided through the center of the retainer 200 such that it firmly pins each end of the retainer against the forearm 100, thus locking the action bars 300 in place. With the magazine tube 400 in place, the ends of the retainer 200 are prevented from being flexed inward, even by the strenuous forces of firing the firearm. Thus, the entire assembly is locked securely in place during use.

Further, in some embodiments the retainer 200 necessarily provides an extra bearing against the magazine tube 400 at the rearward end of the forearm, holding it place. This permits the use of a well-cored polymer forearm, which only requires an extra bearing against the magazine tube at its forward end-since it already has one at its rearward end (the retainer). This widely spread bearing arrangement better guides the forearm during operation than the heavier and more costly forearms which are typically guided by all-steel action slide tube assemblies.

As described, in some embodiments, the retainer 200 bears against the magazine tube 400, and is located at the rearward end of the forearm assembly. In some such embodiments, the longitudinal hole in the forearm 100 through which the magazine tube 400 is passed is formed to bear only at the forward end, and tapered as is necessary to accommodate the molding process. Both ends of the forearm assembly then fit closely with the magazine tube; a desirable feature customarily achieved by the addition of a sleeve or armature.

The present invention allows the forearm component to be readily and repeatedly removed and installed without special tools, and without damaging or adding wear to any of the components. From an assembled state, the magazine tube is removed from the retainer, thus permitting the ends of the retainer flex inward. The operator then uses the end tabs to flex an end of the retainer inward, permitting removal of the action bar. This process is repeated as needed without the use of a tool.

It will be appreciated that various embodiments of the present invention include forearms, forearm retainers, and action bars made from different materials. Some embodiments, include the use of carbon steel. Some embodiments include the use of stainless steel, titanium, aluminum, and other alloys. Some embodiments include the use of carbon fiber in the various components. Some embodiments include the use of polymers. It will be appreciated that certain embodiments include components manufactured with any material adaptable for us in firearms, now known or hereafter developed. In some embodiments, the forearm is a 106426 Forearm. In some embodiments, the forearm retainer is a 106140 forearm retainer. In some embodiments, one or more actions bars is a 106158-1 assembly. In some embodiments, one more action bars is a 106158-2 assembly.

Some embodiments of the present invention include components manufactured by traditional manufacturing means. Some embodiments include components that are 3D printed. It will be appreciated that certain embodiments include components manufactured by any process adaptable to firearms, now known or hereafter developed.

In some embodiments, the forearm includes deep vertical grooves on the gripping surface for secure purchase during operation and recoil. In some embodiments, the forearm includes outward flairs at forward and rearward ends to provide tactile confirmation of correct hand position. In some embodiments, the forearm includes ledges to encourage a "thumb-pointing" grip. In some embodiments, the forearm includes integral slots for attaching a hand strap.

In some embodiments, the present invention is installed in a 590 shotgun. In some embodiments the present invention is installed in a 590 M shotgun. Notwithstanding, it will be appreciated that the present invention is adaptable to a wide variety of shotguns and other firearms, now known or hereafter developed.

In the foregoing description, certain terms have been used for brevity, clearness and understanding; but no unnecessary limitations are to be implied therefrom beyond the requirements of the prior art, because such terms are used for descriptive purposes and are intended to be broadly construed. Moreover, the description and illustration of the inventions is by way of example, and the scope of the inventions is not limited to the exact details shown or described.

Although the foregoing detailed description of the present invention has been described by reference to an exemplary embodiment, and the best mode contemplated for carrying out the present invention has been shown and described, it will be understood that certain changes, modification or variations may be made in embodying the above invention, and in the construction thereof, other than those specifically set forth herein, may be achieved by those skilled in the art without departing from the spirit and scope of the invention, and that such changes, modification or variations are to be considered as being within the overall scope of the present invention. Therefore, it is contemplated to cover the present invention and any and all changes, modifications, variations, or equivalents that fall within the true spirit and scope of the underlying principles disclosed and claimed herein. Consequently, the scope of the present invention is intended to be limited only by the attached claims, all matter contained in the above description and shown in the accompanying drawings shall be interpreted as illustrative and not in a limiting sense.

What is claimed is:

1. A forearm assembly for a firearm, the forearm assembly comprising:

an elongated forearm including a hollow center defining an interior surface, said interior surface including a forearm bar slot along its length and a retainer slot along its circumference;

a retainer configured to be inserted into the retainer slot of the forearm; said retainer including a retainer bar slot that is aligned with said forearm bar slot when the retainer is inserted into the retainer slot;

an action bar configured to be inserted into said forearm bar slot and retainer bar slot such that the action bar is locked in place between the interior surface of the forearm and the retainer.

2. The forearm assembly of claim 1, wherein the retainer generally U-shaped.

3. The forearm assembly of claim 2, wherein the retainer is made of flexible material.

4. The forearm assembly of claim 3, wherein the retainer includes a tab on at least one end, said tab configured to flex the end of the retainer away from the forearm when pulled while the retainer is installed in the forearm, thereby allowing for insertion of the action bar.

5. The forearm assembly of claim 3, further including a magazine tube inserted into the hollow portion of the forearm while the retainer is installed, such that the magazine tube also passes through the center of the installed retainer, thereby preventing flexing of the end of the retainer.

6. The forearm assembly of claim 5, wherein the forearm is a well-cored polymer forearm.

7. The forearm assembly of claim 5, wherein the retainer slot is located at the rearward end of the forearm and the retainer is configured to act as a rear bearing against the magazine tube.

8. The forearm assembly of claim 7, wherein the forearm includes a front bearing located at the frontward end.

9. The forearm assembly of claim 1, wherein said forearm further includes a pocket on the rearward end of the forearm bar slot configured to receive the action bar and prevent the action bar from moving horizontally when installed in the forearm.

10. The forearm assembly of claim 1, wherein the forearm further includes:

a plurality of deep vertical groves on the bottom exterior surface configured to be gripped by the operator;

an outward flair at the forward and reward end;

a horizontal ledge along the exterior outer surface; and an integral slot configured to receive a hand strap attachment.

11. A forearm assembly for a firearm, the forearm assembly comprising:

an elongated forearm including a hollow center defining an interior surface, said interior surface including opposing first and second forearm bar slots along its length and a retainer slot along its circumference;

a generally U-shaped retainer configured to be inserted into the retainer slot of the forearm; said retainer including first and second retainer bar slots on the exterior of each side, such that the first and second retainer bar slots are aligned with the respective first and second forearm bar slot when the retainer is inserted into the retainer slot;

a first and second action bar, each configured to be inserted into the respective forearm bar slot and retainer bar slot such that each action bar is locked in place between the interior surface of the forearm and the retainer.

12. The forearm assembly of claim 11, wherein the retainer is made of flexible material.

13. The forearm assembly of claim 12, wherein the retainer includes a tab on each end, wherein each tab is configured to flex the respective end of the retainer away from the forearm when pulled while the retainer is installed in the forearm, thereby allowing for insertion of the respective action bar.

14. The forearm assembly of claim 12, further including a magazine tube inserted into the hollow portion of the forearm while the retainer is installed, such that the magazine tube also passes through the center of the installed retainer, thereby preventing flexing of the ends of the retainer.

15. The forearm assembly of claim 14, wherein the forearm is a well-cored polymer forearm.

16. The forearm assembly of claim 14, wherein the retainer slot is located at the rearward end of the forearm and the retainer is configured to act as a rear bearing against the magazine tube.

17. The forearm assembly of claim 11, wherein said forearm further includes a first and second pocket on the rearward end of the first and second forearm bar slots, each pocket configured to receive the respective action bar and prevent the action bar from moving horizontally when installed in the forearm.

18. A forearm assembly for a firearm, the forearm assembly comprising:

a forearm; and a retainer configured to be inserted into a retainer slot on an interior surface of the forearm, wherein a first groove along the interior surface of the forearm and a second groove along the exterior of the retainer align to create a bar slot configured to receive an action bar.

19. The forearm assembly of claim 18, wherein the retainer is generally U-shaped and made of flexible material.

20. The forearm assembly of claim 19, wherein the retainer includes a tab on at least one end, said tab configured to flex the end of the retainer away from the forearm when pulled while the retainer is installed in the forearm, thereby allowing for insertion of the action bar.

* * * * *